US007762934B1

(12) United States Patent
Munson, Jr. et al.

(10) Patent No.: US 7,762,934 B1
(45) Date of Patent: Jul. 27, 2010

(54) EXERCISE APPARATUS BASED ON A VARIABLE MODE HYDRAULIC CYLINDER AND METHOD FOR SAME

(75) Inventors: David Murray Munson, Jr., Dallas, TX (US); David Shawn Flatt, Irving, TX (US)

(73) Assignee: FOI Group, LLC, Dallas, TX (US)

( * ) Notice: Subject to any disclaimer, the term of this patent is extended or adjusted under 35 U.S.C. 154(b) by 1481 days.

(21) Appl. No.: 11/119,788

(22) Filed: May 2, 2005

(51) Int. Cl.
*A63B 21/008* (2006.01)

(52) U.S. Cl. ..... 482/112

(58) Field of Classification Search ..... 482/111–113, 482/135–138
See application file for complete search history.

(56) References Cited

U.S. PATENT DOCUMENTS

| | | | | | |
|---|---|---|---|---|---|
| 2,440,577 | A | | 4/1948 | Denby | |
| 3,062,548 | A | | 11/1962 | Foster | |
| 3,587,319 | A | | 6/1971 | Andrews | |
| 3,825,260 | A | | 7/1974 | Thomas | |
| 3,897,060 | A | | 7/1975 | Jennings | |
| 3,955,655 | A | * | 5/1976 | Pornin | 188/313 |
| 4,363,481 | A | * | 12/1982 | Erickson | 482/113 |
| 4,444,390 | A | * | 4/1984 | Erickson | 482/113 |
| 4,722,525 | A | * | 2/1988 | Brentham | 482/137 |
| 4,750,735 | A | * | 6/1988 | Furgerson et al. | 482/73 |
| 4,772,016 | A | * | 9/1988 | Manion | 482/112 |
| 4,848,739 | A | * | 7/1989 | Schaub et al. | 482/113 |
| 4,865,315 | A | | 9/1989 | Paterson | |
| 4,880,230 | A | * | 11/1989 | Cook | 482/113 |
| 4,932,632 | A | | 6/1990 | Nicol | |
| 4,951,941 | A | * | 8/1990 | Resk | 482/112 |
| 4,979,735 | A | | 12/1990 | Stewart | |
| 5,143,372 | A | | 9/1992 | Wilson | |
| 5,250,015 | A | * | 10/1993 | Thornton | 482/112 |
| 5,409,435 | A | | 4/1995 | Daniels | |
| 5,474,290 | A | | 12/1995 | Rascona | |
| 5,527,251 | A | | 6/1996 | Davis | |
| 5,803,879 | A | | 9/1998 | Huang | |
| 6,022,301 | A | * | 2/2000 | Fahlman | 482/111 |
| 6,027,429 | A | | 2/2000 | Daniels | |
| 6,261,195 | B1 | | 7/2001 | Shingleton | |
| 6,413,195 | B1 | | 7/2002 | Barzelay | |
| 6,846,270 | B1 | | 1/2005 | Etnyre | |

* cited by examiner

*Primary Examiner*—Fenn C Mathew
(74) *Attorney, Agent, or Firm*—D. Scott Hemingway; Hemingway & Hansen, LLP

(57) ABSTRACT

The invention is a hydraulic cylinder for use in exercise machines to deliver a controllable fast acting force. The invention uses a hydraulic cylinder with features that allow high acceleration rates, rapid changes of force level and direction, and positive force limitation. In the preferred embodiment, the hydraulic cylinder is composed of a rodless, hydraulic cylinder coupled to a cable and pulley system. A water source delivers water to generate a force against an inner bi-directionally moving piston to generate a regulated movement and force.

The ends of the rodless hydraulic cylinder are sealed by both a water control spool valve and a controllable poppet style pressure relief valve. The water control spool valves adjustably permits water to enter and exit the hydraulic cylinder to regulate the direction and speed of movement of the piston. The pressure relief valve controls the desired maximum pressure and corresponding forces exerted on cylinder. Thus, both the internal speed and force of movement of the piston can be controlled. The invention can deliver high acceleration/speed, high force resistance; high acceleration/speed, low force resistance; low acceleration/speed, high force resistance; or low acceleration/speed, low force resistance exercise forces and movements depending on the water flow, internal pressure, and resulting generated forces.

21 Claims, 6 Drawing Sheets

EXERCISE APPARATUS BASED ON A VARIABLE MODE HYDRAULIC CYLINDER AND METHOD FOR SAME

BACKGROUND OF THE INVENTION

Exercise machines and apparatus using hydraulic cylinders as a resistance or power source have existed for some time. Generally, these prior art methods are limited by design and physics in terms of restricted direction of resistance and speed of response.

The exercise modality for most exercising equipment harnessing hydraulic force is aimed at building strength, muscle mass, and muscle tone. For example, hydraulic dampers have been used to generate a resistance force. This force is generally passive and only provides either a fixed or variable resistance force. An example of such a passive exercise machine is found in U.S. Pat. No. 5,527,251 to Davis which provides for a bidirectional, adjustable resistance exercise machine. Another exercise application for a hydraulic cylinder is found in U.S. Pat. No. 5,803,879 to Huang for a double-acting hydraulic cylinder that delivers a variable resistance to provide a smooth movement and resistance in two directions (e.g. back and forth). Both of these prior art exercise devices are passive devices.

A more ambitious method for an exercise machine using hydraulic forces is found in U.S. Pat. No. 4,865,315 to Paterson et. al. This prior art device provides a manual mode where the user selects a concentric and eccentric force, a pyramid mode where the user selects an automatic increasing progression of concentric and eccentric force, and a maximum strength exercise mode where the user applies maximal muscular force. In this device, a computer controls the hydraulic force and pressures in the hydraulic system to deliver the desired exercise modality. Another exercise device is found in U.S. Pat. No. 6,413,195 to Barzelay. This application provides for either a resistance type operation or a velocity type operation controlled by a computer to deliver a push-pull mode of operation. Another application harnessing hydraulic forces for athletic training is U.S. Pat. No. 3,062,548 to Foster, which discloses a training cart with hydraulic pump to generate a passive resistance to movement.

For the most part, these prior art applications use hydraulic dampers or cylinders to deliver brute force resistance and generally lack dynamic control of the generated resistance. As such, these prior art exercise machines are useful for traditional anaerobic strength training. These conventional applications usually impose higher forces as velocity increases, and systems employing conventional hydraulic cylinders produce high friction forces, rigidity, and penalize high speed exercise.

Any hydraulic cylinder's speed of movement is limited to the velocity of the fluid within the cylinder. This velocity is restricted by the smallest orifice in the system. Most traditional passive exercise cylinder use restrictive orifices to generate exercise forces. While this approach generates exercise forces, these devices are very velocity sensitive and are limited to use in a narrow speed range. Active hydraulic cylinder devices typically have ports and valving that are the limiting factor on speed of movement. Because a typical positive displacement hydraulic cylinder has multiple hydraulic shaft and piston seals, it generates substantial friction forces from these seals. These forces vary with higher initial breakout forces and direction and velocity sensitive dynamic forces.

A need exists for a force generation device for exercise machine applications directed at developing the quick response muscles needed for athletic success. Such a device needs to allow training modalities with dynamic, active responses for increasing agility along with rapidly controllable forces appropriate to the athletic or rehabilitation need. This type of training would be valuable for applications in exercise machines used by athletes training in football, basketball, baseball, track, rowing, as well as for rehabilitation.

SUMMARY OF THE INVENTION

The goal of the invention is to offer a device which delivers active, controllable exercise forces that more closely approximates those actually encountered in certain athletic activities and rehabilitation. The exercise forces generated have applications in developing strength and quickness in fast response muscles unlike traditional strength training devices, which can actually reduce quick response ability, even while increasing muscle mass. Due to its inherent force limiting features and reduced hazard, the invention can be used for general fitness or rehabilitation. The device's goal is to enable quick response strength training that can not safely be accomplished with prior art applications whether by harnessing hydraulic forces or using other methods. Its use also trains athletes for quickness of motion without the drawbacks of excessive kinetic or impact inertia found in prior art applications harnessing hydraulic forces The invention uses a low friction hydraulic cylinder which can utilize water flow velocity to deliver a fast responding controllable force. In the preferred embodiment, the hydraulic cylinder is composed of a rodless, hydraulic cylinder in which the piston is coupled to a cable and pulley system. A water source delivers water to generate a force against an inner bi-directionally moving piston to generate a regulated movement and force.

The ends of the rodless hydraulic cylinder are sealed by a water control spool valve and a controllable pressure relief valve. The water control spool valves adjustably permits water to enter and exit the hydraulic cylinder to regulate the direction and speed of movement of the piston. The controllable pressure relief valve controls maximum pressure at each end regardless of whether the flow controlling spool valve is admitting water to a cylinder end. Thus, the internal speed, direction and force of movement of the piston can be controlled.

In order to produce accelerations and velocity sufficient to safely challenge professional level athletes the invention minimizes the distance between valves and cylinder end, utilizes large valves and ports and the non-positive sealing piston. Additionally, the water supply side of the valve is a hybrid of a closed loop and open loop system. Water is flowing at high speed thru the length of the extended center section of the spool valve at a regulated system pressure. Thus, when the spool valve opens the admitted water is at full velocity and pressure. The flowing nature of the center section additionally prevents water hammer as the water always has a travel path. The invention can deliver high acceleration/speed, high force resistance; high acceleration/speed, low force resistance; low acceleration/speed, high force resistance; or low acceleration/speed, low force resistance exercise forces and movements depending on the water flow, internal pressure, and resulting generated forces.

BRIEF DESCRIPTION OF THE DRAWINGS

The objects and features of the invention will become more readily understood from the following detailed description and appended claims when read in conjunction with the accompanying drawings in which like numerals represent like elements and in which:

DETAILED DESCRIPTION OF THE PREFERRED EMBODIMENTS

Figure 1:
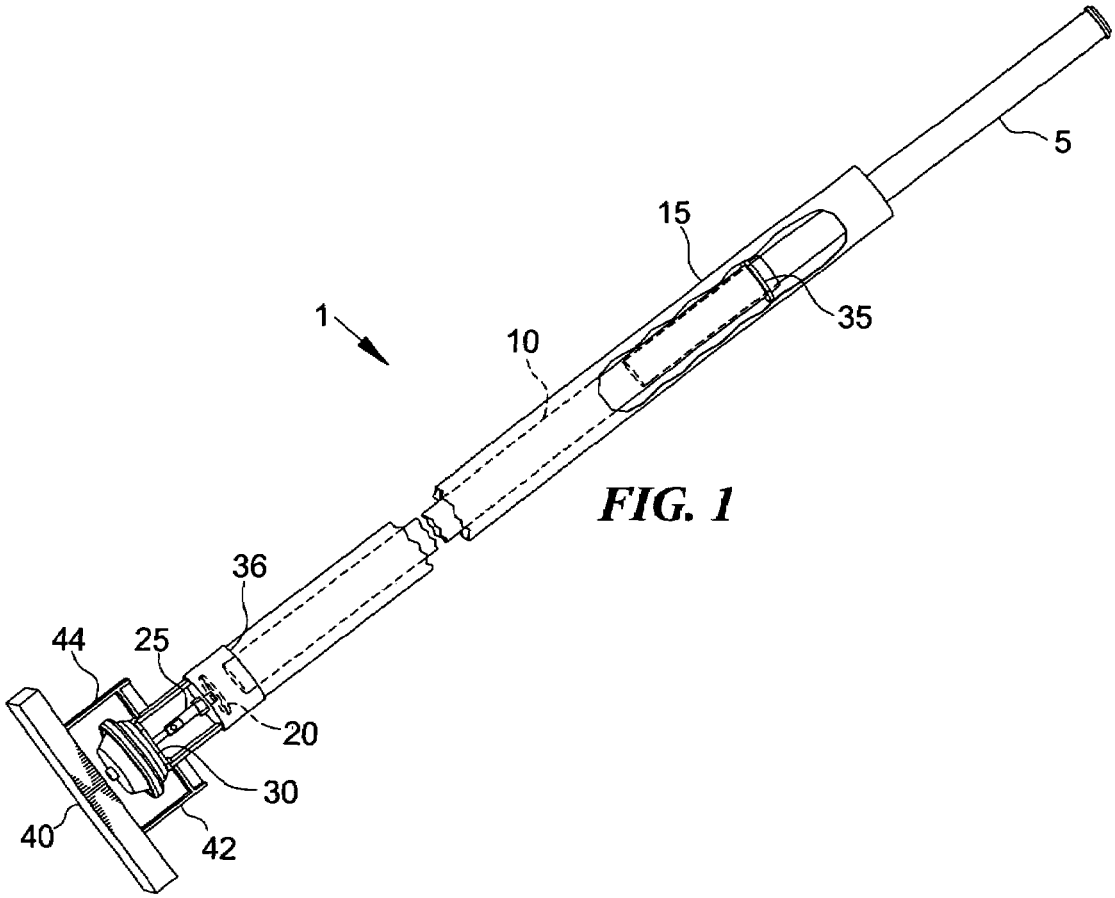
FIG. 1 is an overall view of a first embodiment of the variable mode hydraulic cylinder showing the three concentric cylinders, the controller valve assembly, and the exercise attachment.

For the first embodiment, referring to FIG. 1, the components of the variable mode hydraulic cylinder 1 basically include three cylindrical tubes mated in a concentric manner. A water flow tube 5 connected to a pump or pressurized water source slides into a second tube or hydraulic cylinder 10. The water flow tube 5 possesses a smaller diameter and the mating of the water flow tube 5 and hydraulic cylinder 10 provides a tight fit to restrict or prevent water from flowing back over the exterior of the water flow tube 5, but this fit does not form a water tight seal that can resist all the pressure that can be generated within the hydraulic cylinder 10. Rather, the fit is tight enough to restrict and generally prevent water from flowing out, but the fit is loose enough so that there is little friction between the hydraulic cylinder 10 and the water flow tube 5 allowing the hydraulic cylinder 10 to slide freely over the water flow tube 5. The hydraulic cylinder 10 slides back and forth over the water flow tube 5, which functions as a hydraulic piston in response to the force generated from water flowing into the hydraulic cylinder 10. A water tight seal between the water flow tube 5 and the hydraulic cylinder 10 would impose high friction and resistance to movement in the system, which this invention seeks to minimize or eliminate.

The end of the hydraulic cylinder 10 opposite from where the water flow tube 5 enters the hydraulic cylinder 10 is sealed by a water flow control valve 20. This water flow control valve 20 is connected to a pneumatic force control piston 25 regulated by valve controller 30. The force control piston 25 provides a force feedback to the valve controller 30 and is used to control both pressure at the valve face and the flow rate for water discharging from the hydraulic cylinder 10. Regulating the water pressure directly controls the hydraulic force transmitted onto the face of the water control valve 20 and on to the user. The ability to control force rapidly is performed by the control valve 20. The water being bypassed around the water control valve 20 from the hydraulic cylinder 10 exits into the outer cylinder 15.

When the control valve 20 is completely open, all of the water flow is bypassing to the outer cylinder 15, producing negligible force. Differential flow between the water flow entering and leaving the hydraulic cylinder 10 creates movement of the hydraulic cylinder 10 and attached components, including user engaging mechanisms. If the water control valve 20 is closed off shutting off the bypass, the pressure generated inside the hydraulic cylinder 10 translates into a lateral force, and movement occurs that is directly dependent on the flow rate of water delivered to the hydraulic cylinder 10 through the water flow tube 5.

The control valve 20 can be controlled to permit water at a desired pressure controlled by the valve controller 30 to flow out of the hydraulic cylinder 10, thus controlling the force generated. The speed of the movement can remain fairly constant, at a given flow rate from the water flow tube 5, until the desired pressure is exceeded. Once the desired pressure and related force is reached, the force control piston 25 begins releasing water to maintain the desired pressure, slowing the movement of the cylinder 10 as differential water flow rate drops. As the water control valve 20 is the pathway transmitting forces to the user, it additionally serves as a protection against shock or excessive loads being transmitted to user. As the force generated can be regulated, if a user pushes at a higher force on the device, the hydraulic cylinder 10 moves backwards regardless of the flow rate from tube 5. Excess water is discharged through water control valve 20 allowing movement in both directions. Additionally, by varying the amount of water flow bypassed at the water control valve 20, the speed of movement can also be varied. Thus, the control valve 20 can be used to vary both the speed and force generated.

In application, a control feedback circuit can be used in conjunction with the valve controller 30 and a control on the pump and or valves supplying water to the water flow tube 5 to provide for a constant force, constant speed, varying force, or varying speed. Water flow speed, and resulting speed of movement, can be controlled using a pump that pumps water through the water flow tube 5 rather then the water control valve 20, or controlled using the water control valve 20, or controlled using both.

In this invention, the primary goal is generating fast acting, controllable forces using a low friction, high flow rate hydraulic cylinder assembly and having the water control valve 20 be the force transmission pathway. Control adjustments can be made both at the valve controller 30 and at the pump to generate a high speed/acceleration, high force resistance; high speed/acceleration, low force resistance; low acceleration/speed, high force resistance; or low acceleration/speed, low force resistance. This is accomplished by controlling the force and acceleration/speed generating variables of water flow (in terms of speed and volume) in, water flow out, and pressure buildup, or pressure relief inside the hydraulic cylinder 10. Also, although water is envisioned as the preferred fluid giving the best response, other fluids, such as oil or some other liquid or even air or a gas, can be used to generate the hydraulic forces depending on the actual application and force responses desired.

Figure 2:
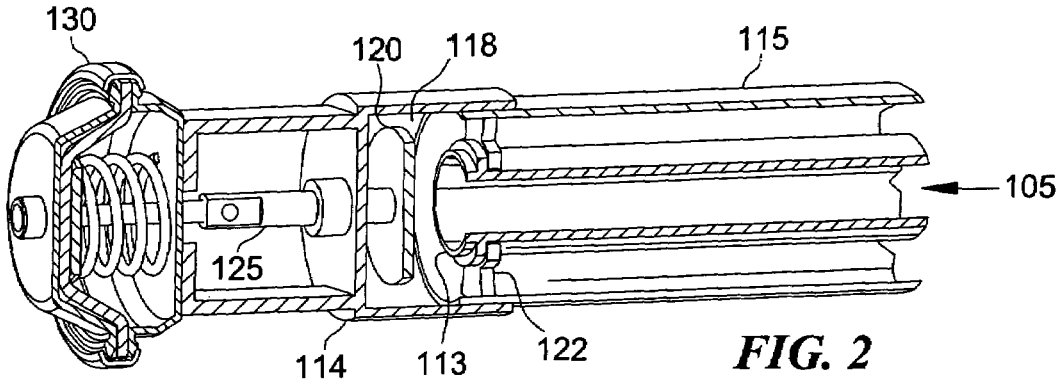
FIG. 2 shows a more detailed view of the area where the hydraulic cylinder and outer cylinder are coupled together with the water control valve.

FIG. 2 shows a more detailed view of the area where the hydraulic cylinder and outer cylinder are coupled together with the water control valve. Water 105 flows down the hydraulic cylinder 110 at a speed and flow rate determinate by the output of the pump or other water source supplying water to the system. The water 105 exits the hydraulic cylinder 110 at flow outlet 113. The hydraulic cylinder 110 is secured in place by a mounting baffle 122 machined, welded, or otherwise secured inside the outer cylinder 115 and to the exterior of hydraulic cylinder 110. The mounting baffle 122 is pierced by radial slots that permit water 105 exiting the hydraulic cylinder 110 to flow into and down the inner wall of the outer cylinder 115 and outer wall of the hydraulic cylinder 110.

The flow rate of water 105 flowing out of the outlet 113 is controlled by the water control valve 120. Water 105 exiting the hydraulic cylinder 110 will generate a force against the hydraulic cylinder head 114 and/or the water control valve 120. The hydraulic cylinder head 114 is formed by sealing the end of the outer cylinder 115. A water chamber 118 is formed by the space between the outlet 113 and the hydraulic cylinder head 114 for the water 105 to flow into and back past the mounting baffle 122 and into outer cylinder 115.

The amount of water 105 permitted to bypass through the water chamber 118 and back into the outer cylinder 115 is dependent on the amount of restriction on the water flow created by the water control valve 120 and to a lesser extent the slots in the mounting baffle 122. The valve controller 130 controls the amount of restrictive force exerted by the force control piston 125.

If the valve controller 130 is set to maintain a 25 pound force, the force control piston 125 will push against the outlet 113 with a 25 pound force exerted on the water control valve 120. When the hydraulic force generated inside the hydraulic cylinder 110 equals 25 pounds, the water control valve is forced open and allows water to bypass the hydraulic cylinder 110 to maintain a constant 25 pound force in the same direction as the water 105 is flowing. The speed induced movement of this force can be adjusted by controlling the water flow speed, which is dependent on the water flow rate and flow speed at the water source and the restriction at the water control valve 120 and also at the outlet of the water flow tube.

Figure 3:
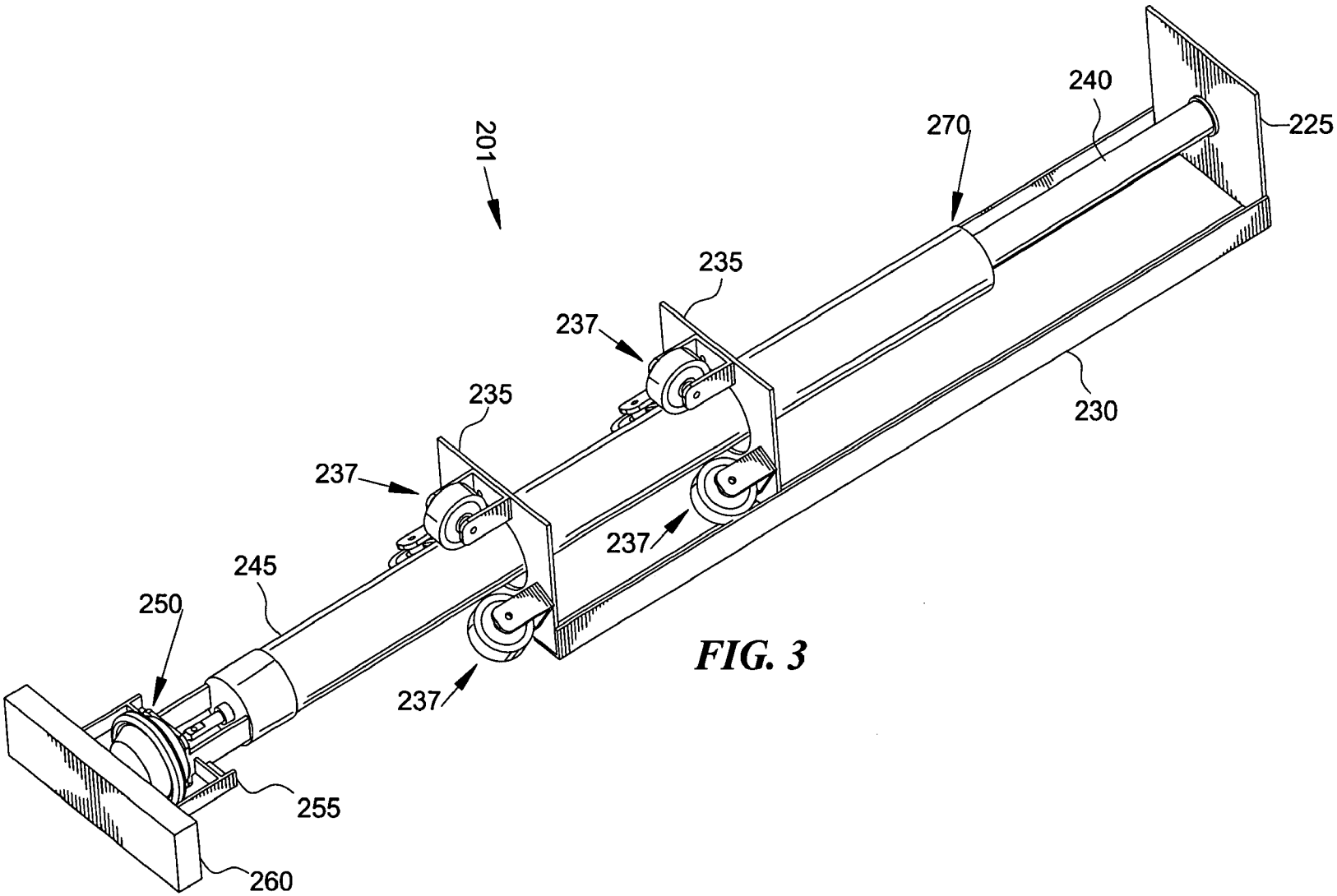
FIG. 3 shows a conceptual embodiment for a simple exercise machine using the variable mode hydraulic cylinder.

FIG. 3 shows the basic concept for a simple exercise machine 201 using the variable mode hydraulic cylinder. A base plate 225 is attached to the base of the water flow tube 240. Two longitudinal supports 230 attach to the base plate 225, and two roller frame assemblies 235 are secured to the longitudinal supports 230. The roller frame assemblies 235 include rollers 237 that support the outer cylinder 245 so the outer cylinder 245 can freely move back and forth. The valve controller 250 regulates the speed and force that the exercise machine 201 can develop by controlling the amount of water bypassing the hydraulic cylinder encased by the outer cylinder 245.

Two mounting brackets 255 secure an exercise attachment 260 to the outer cylinder 245. This exercise attachment 260 can be rigidly mounted, provide for lateral movement, provide for vertical movement, or provide for movement both laterally and vertically. In operation, water enters the hydraulic cylinder through the water flow tube 240. The valve controller 250 regulates the water flow exiting the hydraulic cylinder to generate an exercise force. This water flows into the outer cylinder 245 and out the outlet 270. In the preferred embodiment, it is envisioned that a water tight collection reservoir will surround the outlet 270 to collect the water flowing from the outlet 270 and from around the water flow tube 240 to be used by a water pump providing water to the water flow tube 240 and form a closed circuit water system.

Figure 4:
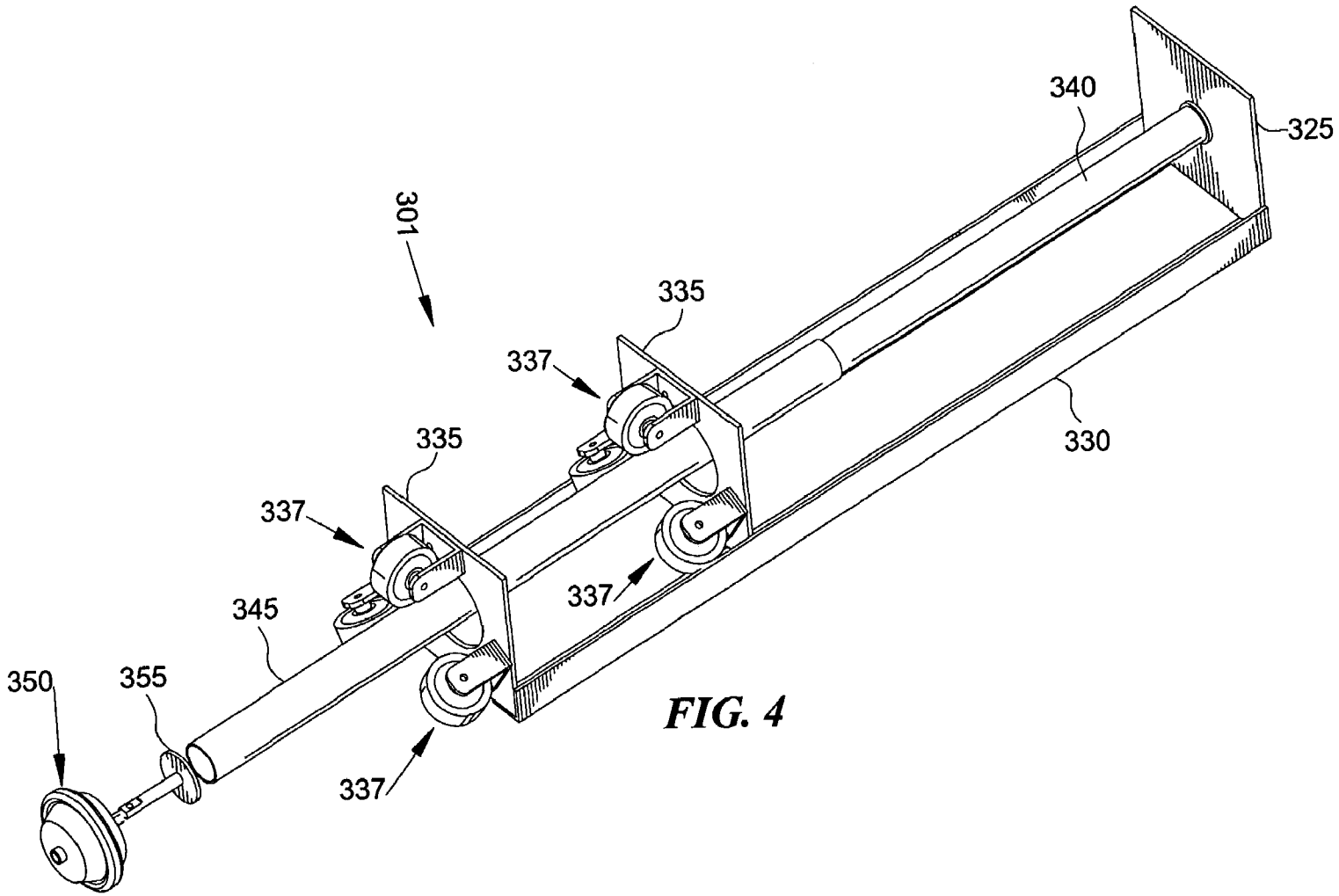
FIG. 4 shows a view with the outer cylinder not shown to show an alternative embodiment for connecting the hydraulic cylinder and the water flow tube.

FIG. 4 shows another view of the exercise machine of FIG. 3 and an alternative embodiment for coupling the hydraulic cylinder and the water flow tube. A base plate 325 is attached to the base of the water flow tube 340. Two longitudinal supports 330 attach to the base plate 325, and two roller frame assemblies 335 are secured to the longitudinal supports 330. The roller frame assemblies 335 include rollers 337 that support the outer cylinder (not shown) so the outer cylinder can freely move back and forth. The valve controller 350 regulates the speed and force that the exercise machine 301 can develop by controlling the amount of water bypassing the hydraulic cylinder 345 encased inside the outer cylinder.

In operation, water enters the hydraulic cylinder 345 through the water flow tube 340. In this embodiment, the water flow tube 340 is of larger diameter compared to the hydraulic cylinder 345 so that the water flow tube 340 slides over the outside of the bypassing hydraulic cylinder 345. The valve controller 350 controls the force control piston 355 to regulate the water flow exiting the bypass hydraulic cylinder 345 and the resulting hydraulic forces. This water flows into the outer cylinder and exits from an outlet. It is envisioned that a water tight collection reservoir will surround the outlet to collect the out flowing water from the outlet and be used by a water pump to provide water to the water flow tube 340 and form a closed circuit water system.

Alternative embodiments are available for handling the water flow exiting the hydraulic cylinder. One alternative embodiment for the water to exit the hydraulic cylinder is to have a flexible hose connected to the hydraulic cylinder to handle the bypass water flow. A water control valve regulates the water flow bypass from hydraulic cylinder into the hose and controls the speed and force generated. The hose would lead to a collection reservoir so water could be used by the pump supplying water to the system. This arrangement would delete the requirement for an outer cylinder. Another embodiment would be to enclose the end of the outer cylinder to form a seal with the surface of the hydraulic cylinder or the water flow tube. An exit drain from the outer cylinder would allow the water to freely flow from the outer cylinder and into a reservoir. Another possible embodiment for this arrangement is to locate the water flow bypass at the outer cylinder. Rather than regulating the force generated using a water flow valve at the end of the hydraulic cylinder, the water would be free to flow into the outer cylinder with the water flow and pressure generated and regulated by controlling the water flow exiting the outer cylinder. Yet another embodiment would replace the water flow tube with a solid piston. Water would be delivered into the hydraulic cylinder proximate to a piston rather than through a water flow tube, and the seal with the piston would be sufficiently tight to restrict water flow but not too tight so as to create excess friction. Water outflow with associated regulated pressure and movement could be by any of the methods discussed above.

Figure 5:
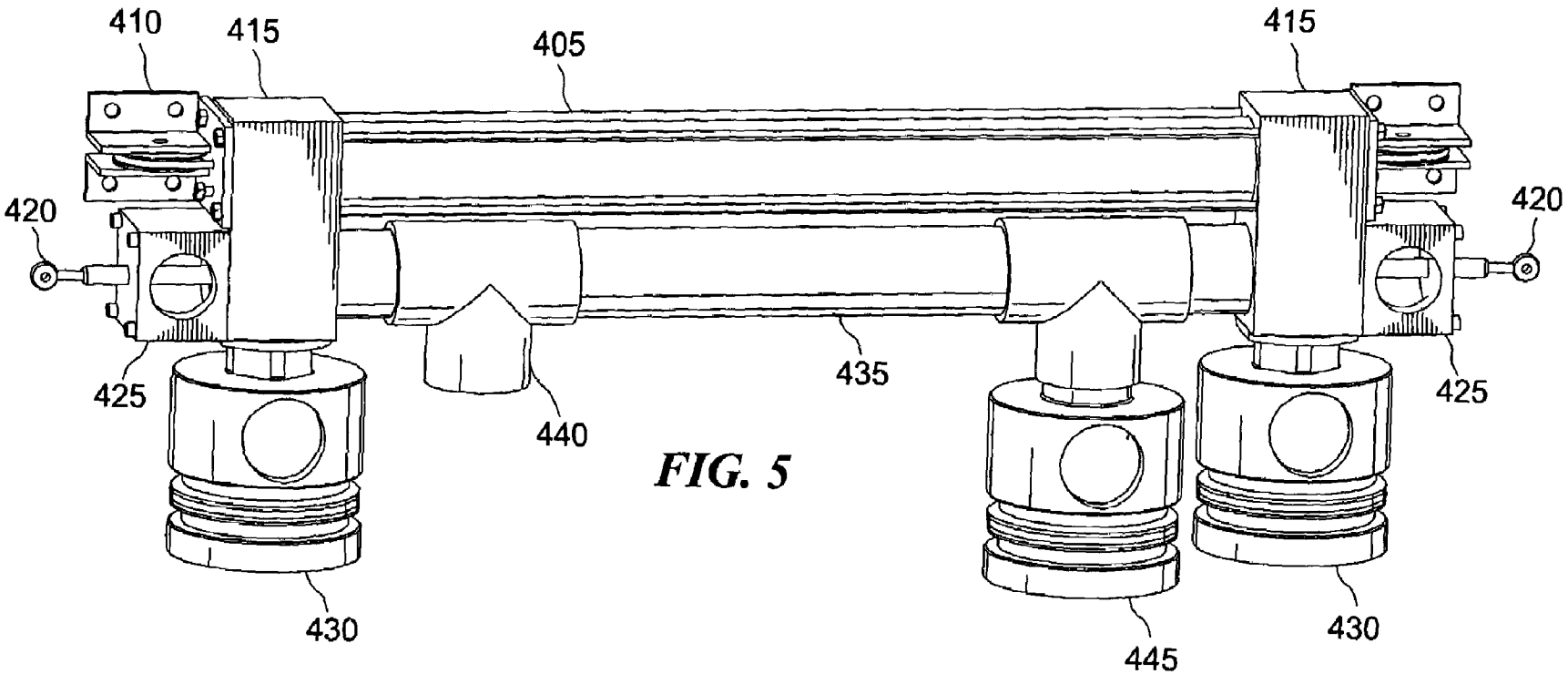
FIG. 5 shows a second embodiment of the variable mode hydraulic cylinder showing the a single hydraulic piston with an internal bidirectional moving piston connected to a flexible cable.

FIG. 5 shows a second embodiment, which is the preferred embodiment, for a hydraulic cylinder generating a fast responding controllable force. The hydraulic cylinder in this embodiment includes a hydraulic cylinder 405 with an internal piston moving bi-directionally. The piston inside the hydraulic cylinder 405 bi-directionally operates a cable and pulley system 410. This type of hydraulic cylinder is also referred to as a rodless cylinder. Water flows into either end of the hydraulic cylinder 405 through an elongated spool valve 415. A spool actuator 420 controls the water flow into the hydraulic cylinder 405 which flows out through a pair of spool exhaust ports 425. A pair of air controlled full-flow adjustable relief valves 430 regulate the pressure of the water flow within the respective sides of the cylinder and thus the force generated on the piston in the hydraulic cylinder 405 independent of spool valve position. The spool valve 435 provides a path for water entering the system through a spool supply port 440 to flow into the hydraulic cylinder 405. A system pressure valve 445 limits the pressure of the spool valves water supply to a desired maximum pressure.

Figure 6:
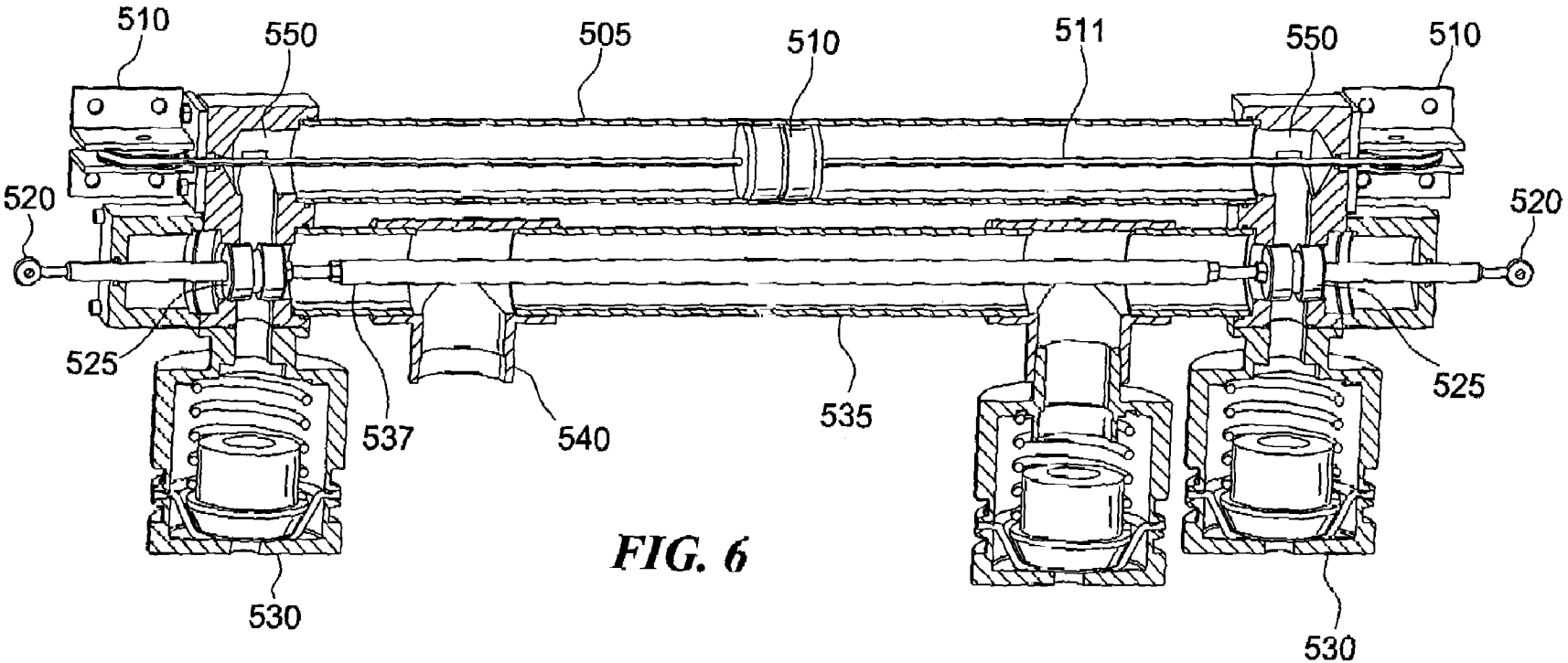
FIG. 6 shows a cross-section view of the variable mode hydraulic cylinder in FIG. 5.

FIG. 6 shows a cross-sectional view of the hydraulic cylinder. The hydraulic cylinder 505 includes a bi-directionally moving piston 510. The piston 510 has a flexible cable 511 that passes through the center of the piston 510 and is securely, mechanically attached. The piston 510 is fitted with some clearance on with the walls of the cylinder 505 such that there is minimal friction with the cylinder 505. This clearance provides additional dissipation of pressure surges.

The flexible cable 511 is part of the cable and pulley system 510 with a pulley 510 mounted on each end of the cylinder 505. The spool cylinder 535 includes a spool shaft 537 which couples the spool valve lands 525 together with the spool valve actuator 520 so that when the spool valve actuator 520 moves the spool lands 525 act in concert to control water flowing into spool port 540 and through the spool cylinder 535 to enter into and out of opposing ends of the hydraulic cylinder 511 through the two spool valve lands 525. The full-flow adjustable relief valves 530 regulate the pressure generated within the hydraulic cylinder 511. The relative flow of water entering through the spool lands 525 generates force against the piston 510 to move the piston 510 bi-directionally within the hydraulic cylinder 511. The pressure relief valve 545 prevents excessive pressure from building up within the water supply system.

Just as in the previous embodiment of FIG. 1, control adjustments can be made both at the spool valve actuator 520, the relief valves 530, and at the pump or other water source to generate a high speed/acceleration, high force resistance; high speed/acceleration, low force resistance; low acceleration/speed, high force resistance; or low acceleration/speed, low force resistance. This is accomplished by controlling the force and acceleration/speed generating variables of water flow (in terms of speed and volume) in, water flow out, and pressure buildup, or pressure relief inside the hydraulic cylinder 505 acting against the hydraulic piston 511. Also, although water is envisioned as the preferred fluid giving the best response, other fluids, such as oil or some other liquid or even air or a gas, can be used to generate the hydraulic forces depending on the actual application and force responses desired.

The cylinder system incorporates several features to increase responsiveness and speed of movement. The spool valve is an integral, large bore spool valve designed with an elongated center so each respective spool valve assembly is positioned in close proximity to the corresponding hydraulic cylinder end and inlet 550 into the hydraulic cylinder 505. Water flows through the spool cylinder 535 center section continuously with inlet and exhaust ports proximate to the respective spool sections, either to power another hydraulic use or exiting the system via the system pressure relief valve, whether either of the spool lands 525 of the spool valves are open for use or closed. The spool valve actuators 520 are fast acting and are able to cycle the spool lands 525 very quickly to generate rapid exercise movements. The design is intended to sharply reduce water hammer, fluid inertial forces, and water velocity and acceleration limitations that would occur in traditional hydraulic systems operated at such high speeds and accelerations. Small accumulators/surge suppressors can also be added proximate to the spool lands 525 to increase flow rate and control pressure fluctuations if required.

Figure 7:
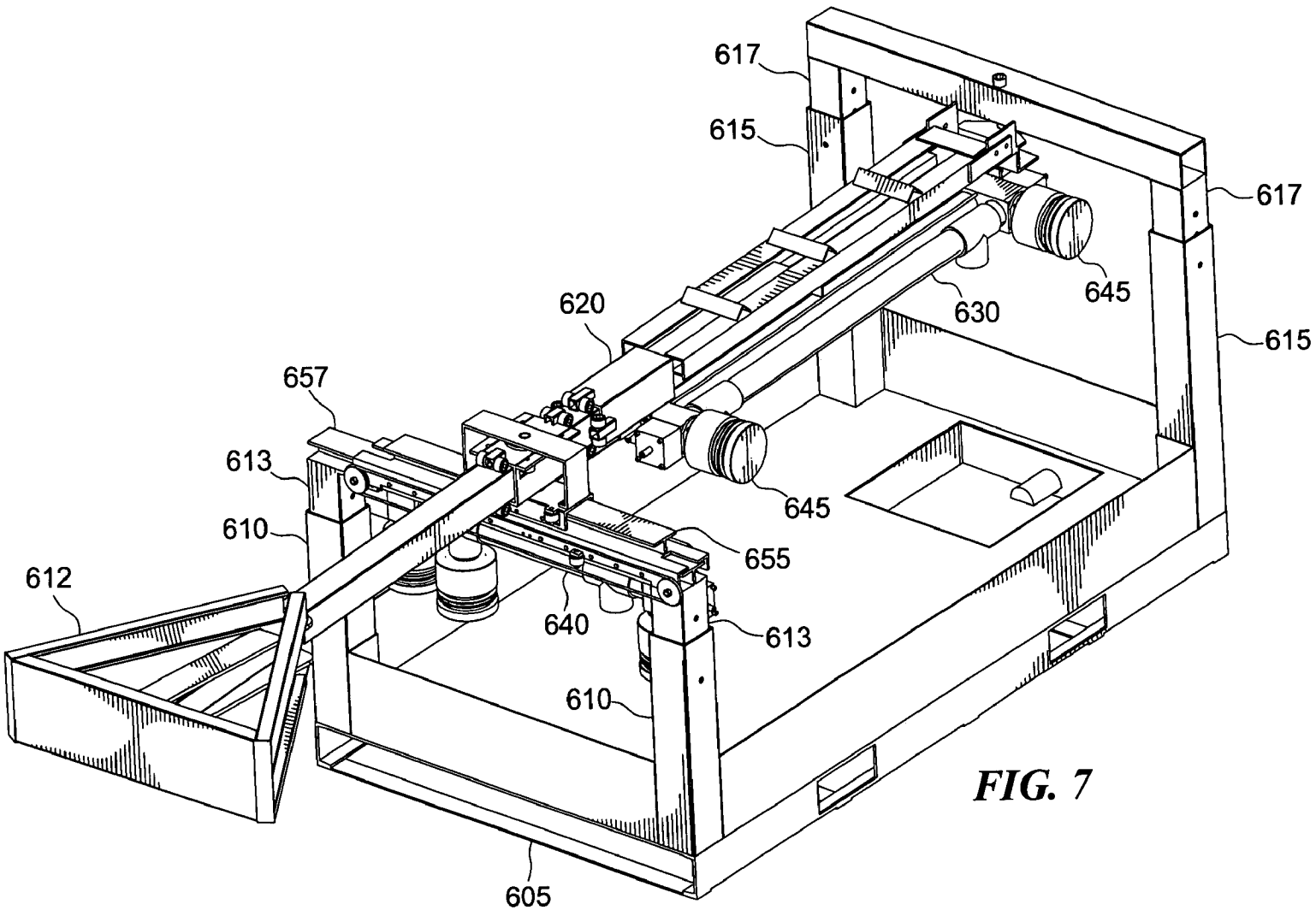
FIG. 7 shows an embodiment of an exercise apparatus using two of the hydraulic cylinders of FIG. 5.

An example of an exercise apparatus using two rodless hydraulic cylinders is shown in FIG. 7. FIG. 7 shows an exercise machine embodiment designed for football athletes to use to improve their speed and strength for blocking, tackling, or similar tasks. The machine consists of a support frame 605. The support frame includes a two-piece set of front support brackets 610 that position and support the user engagement assembly 612 front section of a cylinder support beam 620 of the machine. The support brackets 610 include two-piece telescoping beams 613 so that the height of the user engagement assembly 612 can be adjusted. The support frame also includes a two-piece set of rear support brackets 615 that support the rear part of the cylinder support beam 620 of the machine. The support brackets 615 include two-piece telescoping beams 617 so that the inclination of the user engagement assembly 612 can be adjusted.

The machine includes a horizontal hydraulic cylinder 630 attached to cylinder support beam 620. The cylinder's force transmitting cable is attached to telescoping rectangular tubing which moves back and forth to deliver a thrusting motion and force to the user engagement assembly 612 that is attached to the telescoping tubing. The machine also includes a lateral hydraulic cylinder 640 that moves the telescoping rectangular tube side to side to deliver a lateral movement and force to the user engagement assembly 612. These two or more hydraulic cylinders 630 and 640 impart two bi-directional movements. The use of the lateral hydraulic cylinder 640 for lateral movement and the horizontal cylinder 630 for extension and retraction allows exercise forces and movements to be delivered throughout an exercise area defined by the travel limits of the machine.

The full flow adjustable relief valves 645 positively limit the forces transmitted to the user and allow free movement as a set force limit is exceeded. In the other embodiment of the hydraulic cylinder design, the pressure relief valve 645 serves directly as the means of transmitting force to the user. In this embodiment, the regulated pressure on the piston face creates force which is transmitted to the cable which either directly or indirectly applies force to the user of the machine. The use of a cable system allows a compact, light weight force generation system. The lateral hydraulic cylinder 640 moves an intermediate slide rail 655, one-half of the total desired lateral travel. An upper trolley 657 transmits lateral loads to the telescoping rectangular tube connected to the user engagement assembly 612 and imparts the remaining half of the total lateral travel. The upper trolley's 657 travel is achieved by a cable and pulley system attached to the intermediate rail assembly. Thus, the combined movement is accomplished with a hydraulic cylinder 640 movement of only one-half the desired movement. This allows a total lateral travel in excess of the overall width of the device and moves the support strut assembly 612 more than twice as fast as the hydraulic cylinder 640 movement speed. The horizontal cylinder 630 moves at the same speed and distance as the user moves the user engagement assembly 612.

While the invention has been particularly shown and described with respect to preferred embodiments, it will be readily understood that minor changes in the details of the invention may be made without departing from the spirit of the invention.

Having described the invention, we claim:

1. A method for generating an active force in an exercise machine to create a particular muscular response comprising the steps of:

providing a bypassing fluid flow from a first hydraulic cylinder to generate an active quick response exercise force, said first hydraulic cylinder having a piston with a first end sealed using a first control valve controlled by a first valve controller and a second end sealed using a second control valve controlled by a second valve controller, said first and second valve controller coupled to operate cooperatively so said piston moves bi-directionally along the length of said hydraulic cylinder coupled to a cable;

regulating the fluid flow through the hydraulic cylinder to control the exercise force by using said first and said second control valves to regulate the fluid flow through the hydraulic cylinder, said first and second control values adjustably permitting the fluid flow through the first control valve and the second control valve using said first valve controller and said second valve controller to generate a regulated force and movement of the exercise apparatus by bi-directionally moving said piston coupled to said cable; and controlling the exercise force to deliver variable modalities of force output for a constant force, constant speed, varying force, or varying speed.

2. The method for generating an active force in an exercise machine to create a particular muscular response of claim 1 further comprising the steps of:

providing a second hydraulic cylinder concentrically mated to a third cylinder, a first end of said second hydraulic cylinder sealed opposite from said third cylinder and capable of sliding along a length of the third cylinder, said hydraulic cylinder moving in response to a fluid flow into the second hydraulic cylinder; and adjustably permitting the fluid flow through the second hydraulic cylinder using a third valve controller on a third control valve to control the fluid flow from the second hydraulic cylinder and generate an additional regulated force and movement.

3. The method for generating an active force in an exercise machine to create a particular muscular response of claim 2 wherein the fluid flows through the third cylinder from a fluid source.

4. The method for generating an active force in an exercise machine to create a particular muscular response of claim 2 wherein the source of the fluid flow source into the second hydraulic cylinder is controlled.

5. The method for generating an active force in an exercise machine to create a particular muscular response of claim 1 wherein the fluid flows through the first cylinder from a fluid source.

6. The method for generating an active force in an exercise machine to create a particular muscular response of claim 1 wherein the source of the fluid flow into the first hydraulic cylinder is controlled.

7. The method for generating an active force in an exercise machine to create a particular muscular response of claim 1 wherein valve actuators and relief valves comprise the first valve controller and the second valve controller.

8. The method for generating an active force in an exercise machine to create a particular muscular response of claim 1 wherein the control valve comprises at least one of:

a spool valve;

a poppet valve;

pressure compensated poppet valve; or a rotary Y valve.

9. An exercise apparatus for generating an active force and creating a variable mode muscle response comprising:

a first cylinder having a fluid that can be adjustably controlled to flow in said first cylinder in a regulated manner to provide an exercise force and movement generated by controlling the fluid flow, said first cylinder having a piston with a first end sealed using a first control valve controlled by a first valve controller and a second end sealed using a second control valve controlled by a second valve controller, said first and second valve controller coupled to operate cooperatively so said piston moves bi-directionally along the length of said first cylinder coupled to a cable thereby adjustable permitting the fluid flow through the first control valve and the second control valve to generate a regulated force and movement of the exercise apparatus;

a second cylinder concentrically mated to a third cylinder, a fluid flow in the second cylinder is adjustable permitted to flow using a third valve controller on a third control valve to control the fluid flow and generate an additional regulated force and movement;

a first end of said second cylinder sealed opposite from said third cylinder and said second cylinder capable of sliding along a length of the third cylinder;

a fluid flow out of the second cylinder adjusted using a control valve to regulate the exercise force.

10. The exercise apparatus of claim 9 further comprising:

a high speed, high force exercise force generated by varying the fluid flow.

11. The exercise apparatus of claim 9 further comprising:

a high speed, low force exercise force generated by varying the fluid flow.

12. The exercise apparatus of claim 9 further comprising:

a low speed, high force exercise force generated by varying the fluid flow.

13. The exercise apparatus of claim 9 further comprising:

a low speed, low force exercise force generated by varying the fluid flow.

14. The exercise apparatus of claim 9 further comprising:

a high speed, high force exercise force generated by varying the fluid flow.

15. An exercise apparatus to generate an active force and create variable muscle response comprising:

a first cylinder having a fluid inside the first cylinder that can be adjustably controlled to exit the first cylinder to generate an active exercise force through the use of the control valve that regulates sliding movement of said cylinder, said first cylinder having a first end and a second end concentrically fitting on a second cylinder having a third end and a fourth end;

a non-fluid tight seal formed at the second end of the first cylinder that allows the first cylinder to freely slide back and forth along the second cylinder proximate to the third end;

a control valve capable of sealing the first end of the first cylinder and adjustable for permitting fluid to flow out of the first cylinder, one or more other cylinders concentrically arranged with respect to said first cylinder and allowing fluid to exit from the first cylinder through the control valve, the fluid is adjustably permitted to flow through said first cylinder using a control valve controller on said control valve to control the fluid flow from the first hydraulic cylinder and generate a regulated force and movement;

a third cylinder having a fluid that can be adjustable controlled to flow in said third cylinder in a regulated manner to provide an exercise force and movement generated by controlling the fluid flow, said third hydraulic cylinder having a piston with a first end sealed using a first control valve controlled by a first valve controller and a second end sealed using a second control valve controlled by a second valve controller, said first and second valve controller coupled to operate cooperatively so said piston moves bi-directionally along the length of said third hydraulic cylinder coupled to a cable, said first and second control values adjustably permitting the fluid flow through the first control valve and the second control valve using said first valve controller and said second valve controller to generate a regulated force and movement of the exercise apparatus by bi-directionally moving said piston coupled to said cable.

16. An exercise apparatus for generating an active force and creating a variable mode muscle response comprising:

a first cylinder having a fluid inside the first cylinder that can be adjustably controlled to exit the first cylinder to generate an active exercise force through the use of the control valve that regulates sliding movement of said cylinder, said first cylinder having a first end and a second end concentrically fitting on a second cylinder having a third end and a fourth end;

a second cylinder having a fluid that flows past a first spool valve and a second spool valve to produce an exercise force and cooperatively control bi-directional movement of a piston in said cylinder, said internal piston with a first end sealed using a first spool valve controlled by a first valve controller and a second end sealed using a second spool valve controlled by a second valve controller, said piston moving bi-directionally along the length of said hydraulic cylinder to generate a controlled movement of said exercise apparatus; said first valve controller and said second valve controller adjustably control the flow of fluid through the first and second spool valves to generate a regulated force and movement of the exercise apparatus.

17. The exercise apparatus of claim 16 further comprising:

a high speed, high force exercise force generated by varying the fluid flow.

18. The exercise apparatus of claim 16 further comprising:

a high speed, low force exercise force generated by varying the fluid flow.

19. The exercise apparatus of claim 16 further comprising:

a low speed, high force exercise force generated by varying the fluid flow.

20. The exercise apparatus of claim 16 further comprising:

a low speed, low force exercise force generated by varying the fluid flow.

21. The exercise apparatus of claim 16 further comprising:

a high speed, high force exercise force generated by varying the fluid flow.

* * * * *